US010813391B2

(12) United States Patent
Kull et al.

(10) Patent No.: US 10,813,391 B2
(45) Date of Patent: Oct. 27, 2020

(54) ELECTROLUMINESCENT COMPACT LAMINAR ELEMENT

(71) Applicant: LIGHT FLEX TECHNOLOGY, S.L., Barcelona (ES)

(72) Inventors: Marten Kull, Barcelona (ES); Victoria Backsin, Barcelona (ES); Cristina Casellas Coll, Mataro Barcelona (ES); Santiago Perez De La Hoz, Mataro Barcelona (ES)

(73) Assignee: LIGHT FLEX TECHNOLOGY, S.L., Barcelona (ES)

( * ) Notice: Subject to any disclaimer, the term of this patent is extended or adjusted under 35 U.S.C. 154(b) by 6 days.

(21) Appl. No.: 15/302,719

(22) PCT Filed: Apr. 7, 2014

(86) PCT No.: PCT/ES2014/070269
§ 371 (c)(1),
(2) Date: Oct. 7, 2016

(87) PCT Pub. No.: WO2015/155382
PCT Pub. Date: Oct. 15, 2015

(65) Prior Publication Data

US 2017/0027249 A1 Feb. 2, 2017

(51) Int. Cl.
*A41D 13/01* (2006.01)
*H05B 33/02* (2006.01)
(Continued)

(52) U.S. Cl.
CPC ..... *A41D 13/01* (2013.01); *A41D 13/0015* (2013.01); *A41D 27/085* (2013.01);
(Continued)

(58) Field of Classification Search
CPC .. A41D 13/01; A41D 13/0015; A41D 27/085; F21V 33/0008; F21V 23/0471;
(Continued)

(56) References Cited

U.S. PATENT DOCUMENTS 4,637,148 A 1/1987 Barlow
5,245,516 A * 9/1993 de Haas ..... A41D 13/01 2/338

(Continued)

FOREIGN PATENT DOCUMENTS

ES 1065607 U 10/2007
ES 1071914 U 4/2010
ES 1075259 U 8/2011

OTHER PUBLICATIONS

International Search Report dated Nov. 4, 2014, from the corresponding PCT/ES2014/070269.

(Continued)

*Primary Examiner* — Cara E Rakowski
*Assistant Examiner* — Jessica M Apenteng
(74) *Attorney, Agent, or Firm* — Katten Muchin Rosenman LLP

(57) ABSTRACT

A compact electroluminescent laminar element includes a flexible electroluminescent lamp and an electronic module which is connected in the same layer as the lower electrode to the lamp and includes at least an electronic control component, an electronic component for activating the lamp, and a battery, where the lamp and the electronic module are housed together in an encapsulating substrate consisting of a textile or plastic material, forming a closed and compact element that can be water-impermeable. The activation component is a push-button, a temperature sensor, or a movement sensor. It also comprises a reflective layer.

10 Claims, 2 Drawing Sheets

(51) Int. Cl.

| | |
|---|---|
| ***H01J 1/70*** | (2006.01) |
| ***A41D 13/00*** | (2006.01) |
| ***A41D 27/08*** | (2006.01) |
| ***F21V 33/00*** | (2006.01) |
| *F21L 4/00* | (2006.01) |
| *F21V 1/00* | (2006.01) |
| *F21V 23/04* | (2006.01) |
| *F21V 31/00* | (2006.01) |
| *F21W 121/06* | (2006.01) |
| *F21Y 105/00* | (2016.01) |
| *H05B 33/04* | (2006.01) |
| *H05B 33/14* | (2006.01) |
| *H05B 33/26* | (2006.01) |

(52) U.S. Cl.
CPC ..... *F21V 33/0008* (2013.01); *H01J 1/70* (2013.01); *H05B 33/02* (2013.01); *F21L 4/00* (2013.01); *F21L 2005/00* (2013.01); *F21V 23/0414* (2013.01); *F21V 23/0471* (2013.01); *F21V 23/0485* (2013.01); *F21V 31/00* (2013.01); *F21W 2121/06* (2013.01); *F21Y 2105/00* (2013.01); *H05B 33/04* (2013.01); *H05B 33/14* (2013.01); *H05B 33/26* (2013.01)

(58) Field of Classification Search
CPC ..... F21V 23/0485; F21V 31/00; H01J 1/70; F21L 4/00; F21L 2005/00; F21W 2121/06; F21Y 2105/00; H05B 33/26; H05B 33/02; H05B 33/04; H05B 33/14
USPC ..... 362/235
See application file for complete search history.

(56) References Cited

U.S. PATENT DOCUMENTS

| | | | | |
|---|---|---|---|---|
| 5,317,488 | A * | 5/1994 | Penrod | H05B 33/02 362/84 |
| 5,491,355 | A | 2/1996 | Wei et al. | |
| 5,491,377 | A | 2/1996 | Janusauskas | |
| 6,369,793 | B1 * | 4/2002 | Parker | G02F 1/13452 345/107 |
| 2004/0207330 | A1 * | 10/2004 | Ruffell | G09F 13/22 315/169.3 |
| 2007/0161314 | A1 | 7/2007 | Pendlebury et al. | |
| 2010/0231113 | A1 | 9/2010 | Hehenberger | |
| 2014/0071654 | A1 * | 3/2014 | Chien | H01H 13/704 362/23.03 |
| 2014/0139353 | A1 * | 5/2014 | Wojcieszak | A43B 3/001 340/870.16 |

OTHER PUBLICATIONS

The extended European search report dated Oct. 9, 2017, from the corresponding European Application No. 14889141.9.

* cited by examiner

ELECTROLUMINESCENT COMPACT LAMINAR ELEMENT

The invention, as expressed in the title of this specification, relates to an electroluminescent compact laminar element that offers several advantages and innovative characteristics inherent to its particular configuration, that will be described in detail further below and which represent a novelty in the current state of the art.

Specifically, the invention relates to a flexible lamp that emits electroluminescent light which is incorporated to a substrate, preferably textile or plastic material in order to, for example, be applied to clothing items which, encapsulated with a variable shapes and dimensions, incorporates both the lamp in itself and the control electronics and supply battery.

FIELD OF APPLICATION OF THE INVENTION

The field of application of the present invention falls within the industry sector dedicated to the manufacture of electroluminescent and reflective textiles and similar elements.

BACKGROUND OF THE INVENTION

The existence of flexible electroluminescent lamps which, consisting of laminae formed by several layers, emit their own light when connected to a power supply is known, which are normally destined to being incorporated to garments to provide protection and safety in situations of poor visibility.

However, these laminae have certain limitations, the main one being the fact that they are designed to be an independent part of the control electronics and power supply, normally a battery external to the laminae and to the garment, due to which said laminae incorporate the connections at their ends, which necessarily requires certain design and application limitations.

In reference to the current state of the art, it should be noted that patent US2010231113 discloses a "Reflective and electroluminescent laminated article" that includes one or more electroluminescent structures which in some embodiments may be discontinuous therebetween and, additionally, one or more retro-reflective structures discontinuous therebetween and, optionally, a removable substrate film disposed on the electroluminescent structures and retro-reflective structures.

Patent US2007/161,314 also discloses a "Method for manufacturing an electroluminescent lamp", comprising a front electrode, a phosphorous layer, a dielectric layer and an electrode layer. Connection devices are joined to each division electrode area and are adapted to be connected to a power supply.

U.S. Pat. No. 5,491,377 also discloses a "Method and an electroluminescent lamp" which, also comprising a substrate layer, a lower electrode, an intermediate phosphorous layer, an active dielectric layer, an upper layer, a conductor and a protective or encapsulating layer, in this case envisages a single non-hygroscopic binder that is used for all the layers (with the optional exception of the rear or lower electrode), thereby reducing delamination as a result of the changes in temperature and susceptibility to humidity.

However, it is not observed that any of the aforementioned inventions and patents, considered separately or jointly, describe the present invention, as claimed.

EXPLANATION OF THE INVENTION

The electroluminescent compact element proposed is therefore a novelty in its field of application that resolves the aforementioned drawbacks, the characterising details being conveniently included in the final claims that accompany the present specification.

As mentioned earlier, what the invention proposes is a flexible electroluminescent lamp having a textile or plastic material substrate, preferably applicable to being incorporated to clothing items or accessories, with the essential peculiarity of consisting of a compact body that incorporates the lamp and control electronics with the supply battery encapsulated in a single element, which allows the adoption of shapes and dimensions that will be variable as deemed convenient or as desired in each case, also according to the manufacturer or final application.

Mention should also be made of the fact that said encapsulation is preferably made of a layer of textile material, although it is optionally made of waterproof material, thereby obtaining a water-resistant product without any type of maintenance that may be made of plastic material, polycarbonate, aramid or polyester.

This configuration offers the advantage of being able to use the element of the invention with the conventional function of providing active lighting in garments destined for protection and security in situations of poor visibility, for example, by emergency services operators or personnel, but also as a purely aesthetic or decorative element that provides original active lighting that can be incorporated to any type of garment, sporting or otherwise, which is washable an can adopt any configuration and shape, for example, a logo of a commercial brand, making it clearly visible, particularly in the dark and, therefore, very conspicuous.

Likewise and according to another additional characteristic of the invention, the electroluminescent compact laminar element envisages the incorporation of different lamp activation options, which may be by means of a pushbutton that can be actuated at will, or by means of a resistive sensor that activates the lamp on coming into contact with the skin of the user wearing the garment, or by means of a motion sensor that activates it when the user moves, or a combination of said options.

Lastly, the inclusion of a reflective lamina that combines the properties of own light emission and reflection of light with the electroluminescent lamp is optionally envisaged in the advocated element.

Therefore, the previously described electroluminescent compact laminar element consists of an innovative structure of structural and constituent characteristics hitherto unknown for the intended purpose, reasons which, added to their practical utility, provide sufficient grounds for obtaining the privilege of exclusiveness applied for.

DESCRIPTION OF THE DRAWINGS

As a complement to the description being made, and for the purpose of helping to make the characteristics of the invention more readily understandable, this specification is accompanied by a drawing constituting an integral part thereof which, by way of illustration and not limitation, represents the following.

PREFERRED EMBODIMENT OF THE INVENTION

Figure 1:
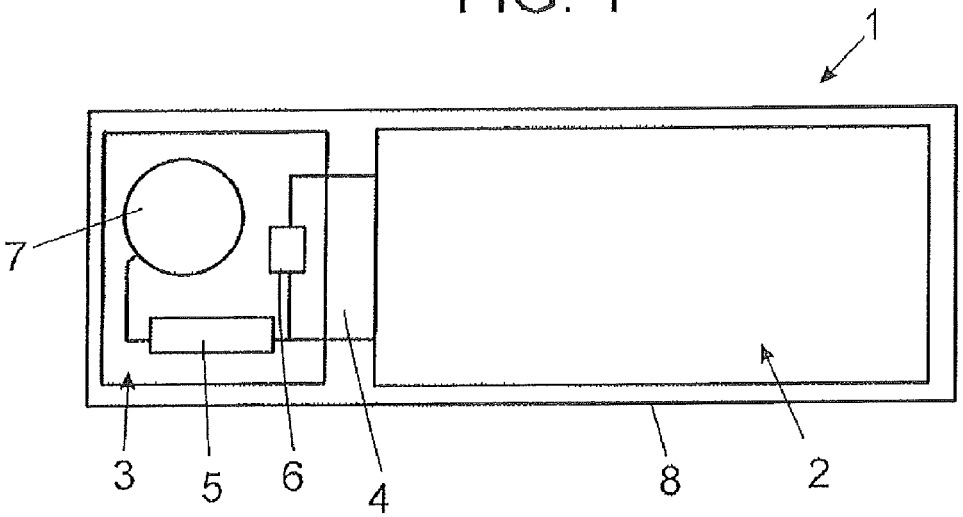
FIG. 1. Shows a schematic plan view of an example of embodiment of the electroluminescent compact laminar element object of the invention, wherein its main constituent elements and their distribution can be observed, represented with the substrate layer not covering the element in order to provide a clearer view of the components housed therein.

In light of the aforementioned figures and in accordance with the numbering adopted, corresponding non-limiting examples of embodiment of the advocated compact electroluminescent lamp can be observed therein, which comprises the parts and elements indicated and described in detail below.

Therefore, as can be observed in said figures, the element (1) in question comprises: a flexible electroluminescent lamp (2) composed in a conventional and already known manner by a series of laminar layers which have not been represented due to being already known and having, at least, one lower electrode, a phosphorescent layer, an active dielectric layer, an upper electrode and a conductor; and an electronic module (3) which, associated with said lamp (2) on the same layer as the lower electrode (4) thereof, incorporates, at least, on one printed circuit an electronic control component (5), a lamp (2) light-up electronic activation component (6) and a supply battery (7), said lamp (2) and said electronic module (3) being jointly housed inside an encapsulating substrate (8), constituting a closed and compact element.

The lamp (2) may have the shape of a sign, graphic message, logo or flat symbol, manufactured by conductive ink printing on a textile substrate, without a continuity solution with the printed circuit of the electronic module (3). Said conductive ink of the lamp (2) comprises an electroluminescent material such as, for example, zinc sulphide, and a conductive material such as, for example, Cu or Ag ink.

Furthermore, the encapsulating substrate (8) may consist of a textile material or polycarbonate plastic, aramid, polyester or other and, in any case, have waterproof and water-resistant properties, either due to the characteristics of the material itself or due to having been subjected to a treatment provided thereto, constituting in such case a watertight and flexible element with similar properties to a waterproof garment in terms of flexibility and feel.

Furthermore, the aforementioned lamp (2) light-up electronic activation component (6) consists of either a pushbutton that the user can actuate at will or a resistive sensor which, on coming into contact with the user's skin, activates lamp (2) light-up, or of a motion sensor or other similar device. Specifically, it may incorporate, as an electronic activation component (6) activated by the user's movement, a reed switch or accelerometer, or a gyroscope or a magneto resistor or any other element that detects movement. Likewise, optionally, the inclusion of more than one electronic activation component (6) in the electronic module (3) combining one of the aforementioned options is envisaged.

Figure 2:
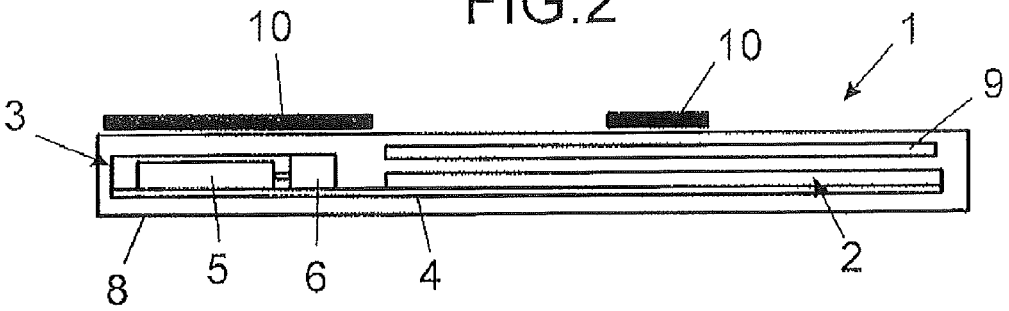
FIG. 2. Shows a schematic longitudinal-section view of another example of the electroluminescent element of the invention, in this case envisaging a reflective layer and corresponding segments of blockout layer.
Figure 3:
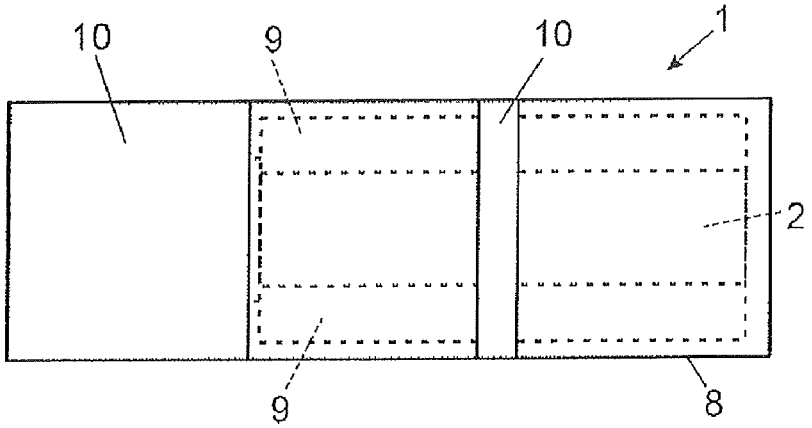
FIG. 3. Shows a schematic plan view of the element of the invention shown in FIG. 2.
Figure 4:
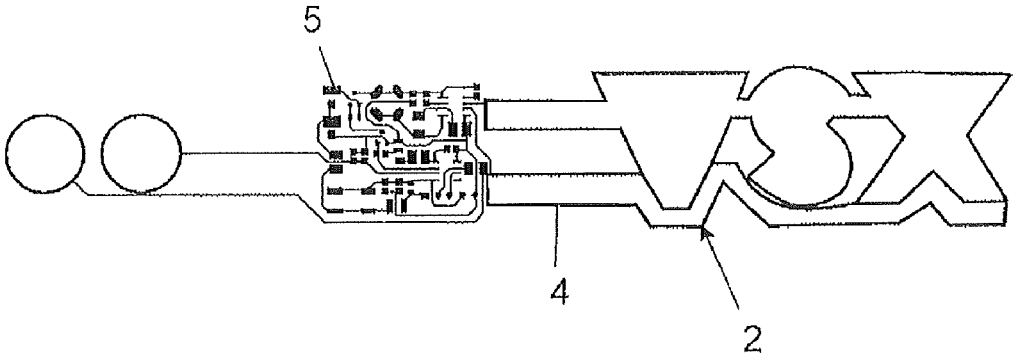
FIG. 4. Shows a plan view of a possible example of embodiment of the lamp and the circuit of the electronic module envisaged by the element of the invention, observing its mutual association in a single layer by means of the lower electrode.

According to FIGS. 2 and 3, it can be observed that the inclusion of a reflective layer (9) that can fully or partially encompass the surface of said lamp (2) in the described encapsulating substrate (8) and on the lamp (2) is also optionally envisaged, disposed in any case such as to allow the reflection of external light and allows the light emitted by the electroluminescent lamp (2) to pass through.

Lastly, in order to achieve the configuration of different models and shapes in the design of the proposed element (1), particularly when it envisages more than one continuous area, the incorporation of one or more blockout layers (10) is optionally envisaged which, distributed in certain segments and/or shapes and disposed at the points that must be conveniently darkened, may define spaces wherethrough the light of the lamp (2) may pass to give it the envisaged shape, also serving, preferably, to conceal the electronic module (3). However, these blockout layers, which are preferably incorporated externally to the encapsulating (8) substrate, do not represent an essential element since, as indicated previously, the lamp (2) may have a certain contour that already defines its shape on printing the zones that must have light with conductive ink.

Having sufficiently described the nature of the present invention, as well as the manner in which to put it into practice, it is not considered necessary to further extend its explanation so that any person skilled in the art understands its scope and advantages derived therefrom, stating that, within its essentiality, it may be put into practice in other modes of embodiment that differ in detail from that indicated by way of example, and which also fall under the protection sought, provided that it does not alter, change or modify its basic principle.

The invention claimed is:

1. An electroluminescent compact laminar element for application to clothing items or accessories, the electroluminescent compact laminar element comprising:

a flexible electroluminescent lamp in a first layer;

a lower electrode in the first layer; and a printed circuit bound with the flexible electroluminescent lamp on the same layer as the lower electrode, the printed circuit comprising one electronic control component, one light-up electronic activation component, and a battery;

wherein the lamp and the printed circuit are jointly housed inside an encapsulating substrate, the substrate being a closed and compact element;

wherein the light-up electronic activation component comprises a pushbutton, a resistive sensor, or an element that detects movement, characterized in that the battery is placed in the same layer as the lower electrode, the electroluminescent lamp, and the printed circuit.

2. The electroluminescent compact laminar element according to claim 1, wherein the lamp has the contour of a sign, graphic message, logo or flat symbol, the light comprising conductive ink printing on a textile substrate, the light being manufactured without a solution continuity with the printed circuit.

3. The electroluminescent compact laminar element according to claim 2, wherein the conductive ink of the lamp (2) comprises an electroluminescent material;

wherein the electroluminescent material comprises zinc sulphide and a conductive material, wherein the conductive material is selected from Cu or Ag.

4. The electroluminescent compact laminar element according to claim 1, wherein the encapsulating substrate is a textile material.

5. The electroluminescent compact laminar element according to claim 1, wherein the encapsulating substrate comprises a plastic material.

6. The electroluminescent compact laminar element according to claim 1, wherein the encapsulating substrate is waterproof and water-resistant, constituting a watertight and flexible element.

7. The electroluminescent compact laminar element according to claim 1, wherein the electronic module incorporates more than one lamp light-up electronic activation component.

8. The electroluminescent compact laminar element according to claim 1, wherein a reflective layer is included in the encapsulating substrate and on the lamp, disposed such as to allow the reflection of external light and also to allow the light emitted by the lamp to pass through.

9. The electroluminescent compact laminar element according to claim 1, further comprising a blockout layer, the blockout layer being distributed in segments or shapes and being disposed at points to be conveniently darkened, the blockout layer defining spaces wherethrough light of the lamp can pass to give the lamp shape.

10. The electroluminescent compact laminar element according to claim 9, wherein the blockout layers incorporated externally to the encapsulating substrate.

* * * * *